US007614911B2

(12) United States Patent
Hsieh et al.

(10) Patent No.: US 7,614,911 B2
(45) Date of Patent: Nov. 10, 2009

(54) STRAIN RELIEF COLLAR FOR ACCESSORIES ASSOCIATED WITH MOBILE DEVICE AND METHOD OF MAKING

(75) Inventors: Fang-Chang Hsieh, Taichung (TW); I-Ming Lin, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 60 days.

(21) Appl. No.: 11/937,522

(22) Filed: Nov. 9, 2007

(65) Prior Publication Data

US 2009/0124115 A1 May 14, 2009

(51) Int. Cl.
*H01R 13/58* (2006.01)

(52) U.S. Cl. ..... 439/604; 174/135; 439/447

(58) Field of Classification Search ..... 439/604, 439/606, 445, 447; 174/135, 153 G, 152 R, 174/153 R; 16/2.5; 29/856, 883; 264/272.15
See application file for complete search history.

(56) References Cited

U.S. PATENT DOCUMENTS 1,487,937 A * 3/1924 Griffin ..... 439/502
2,508,638 A * 5/1950 Bricker ..... 439/447
2,715,212 A * 8/1955 Kokalas et al. ..... 439/144
3,914,003 A * 10/1975 Loy ..... 439/126
4,032,214 A * 6/1977 McNerney ..... 439/606
5,571,145 A * 11/1996 Drebin ..... 607/37
5,929,386 A * 7/1999 Hornick ..... 174/135
6,805,826 B2 * 10/2004 Coombs ..... 264/272.15
7,018,236 B2 * 3/2006 Nishio et al. ..... 439/606

* cited by examiner

*Primary Examiner*—Neil Abrams
(74) *Attorney, Agent, or Firm*—Muncy, Geissler, Olds & Lowe, PLLC

(57) ABSTRACT

The present invention discloses a strain relief collar for use with an accessory associated with a mobile device and its method of making. The first step is the making of an outer molded body having an engagement portion with a cutout. The second step is inserting a cord into the outer molded body. The third step is the forming of an inner molded body having a hooking portion extending outward from the periphery thereof and beyond the cutout for engaging with an accessory. The present invention also discloses another strain relief collar for use with another accessory associated with a mobile device and its method of making. The first step is connecting the cord to an electrical component associated with the accessory. The second step is the forming of an inner molded body. The third step is the forming of an outer molded body.

9 Claims, 16 Drawing Sheets

STRAIN RELIEF COLLAR FOR ACCESSORIES ASSOCIATED WITH MOBILE DEVICE AND METHOD OF MAKING

BACKGROUND OF THE INVENTION

1. Field of the Invention

The present invention relates to a strain relief collar for use with accessories associated with a mobile device and its method of manufacture, in particular to a strain relief collar which has a smooth outer periphery, prevents excessive bending of a cord and inhibits the cord from being pulled off a connection.

2. Description of the Related Art

Referring to FIG. 1, an accessory associated with a mobile device comprises a microphone 1 having two earphones 2 and a wire 3 for cooperation with a plug 4 connected. Such an accessory suffers a problem, namely, the wire 3 attached to a circuit board (not shown) of the microphone 1 can be easily detached if the wire 3 is accidentally pulled with respect to the microphone 1. Another problem is that an excessive bending stress normally occurs between the microphone 1 and the wire 3 when the wire 3 is overly twisted. As a result, the wire 3 also gets detached from the circuit board, causing a broken circuit.

Referring to FIG. 2, the microphone 1 further includes a strain relief collar 5 which is adapted to prevent excessive bending of the wires 3. Nevertheless, such a strain relief collar 5 will not effectively prevent wires 3 from being pulled off the circuit board accidentally-in that the strain relief collar 5 is made of soft material and the wires 3 are only gripped by the strain relief collar 5. Furthermore, since the strain relief collar 5 has a plurality of recessed portions, dirt can easily accumulate in the recessed portions.

The present invention is, therefore, intended to obviate or at least alleviate the problems encountered in the prior art.

SUMMARY OF THE INVENTION

It is therefore an object of the present invention to provide a strain relief collar for accessories associated with a mobile device which overcomes the disadvantages of the prior arts.

It is another object of the present invention to provide a strain relief collar and methods for making the same.

It is also another object of the present invention is to provide a strain relief collar which cooperates with a wire having a connection with a circuit board of an accessory for preventing easy detachment of the wire from the circuit board if the wire is accidentally pulled with respect to the circuit board, and methods for making the same.

It is yet another object of the present invention is to provide a strain relief collar which prevents an excessive bending occurred between the wire and the accessory and methods for making the same.

It is a further object of the present invention is to provide a strain relief collar with a smooth outer surface so as to prevent accumulation of dirt and methods for making the same.

Thus, the present invention provides a method for making a strain relief collar, in which the method comprises making of an outer molded body as the first step; inserting a cord into the outer molded body as the second step; forming of an inner molded body as the third step.

The present invention also discloses another method of making, in which the first step is connecting the cord to an electrical component associated with the accessory; the second step is the forming of an inner molded body and the third step is the forming of an outer molded body.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
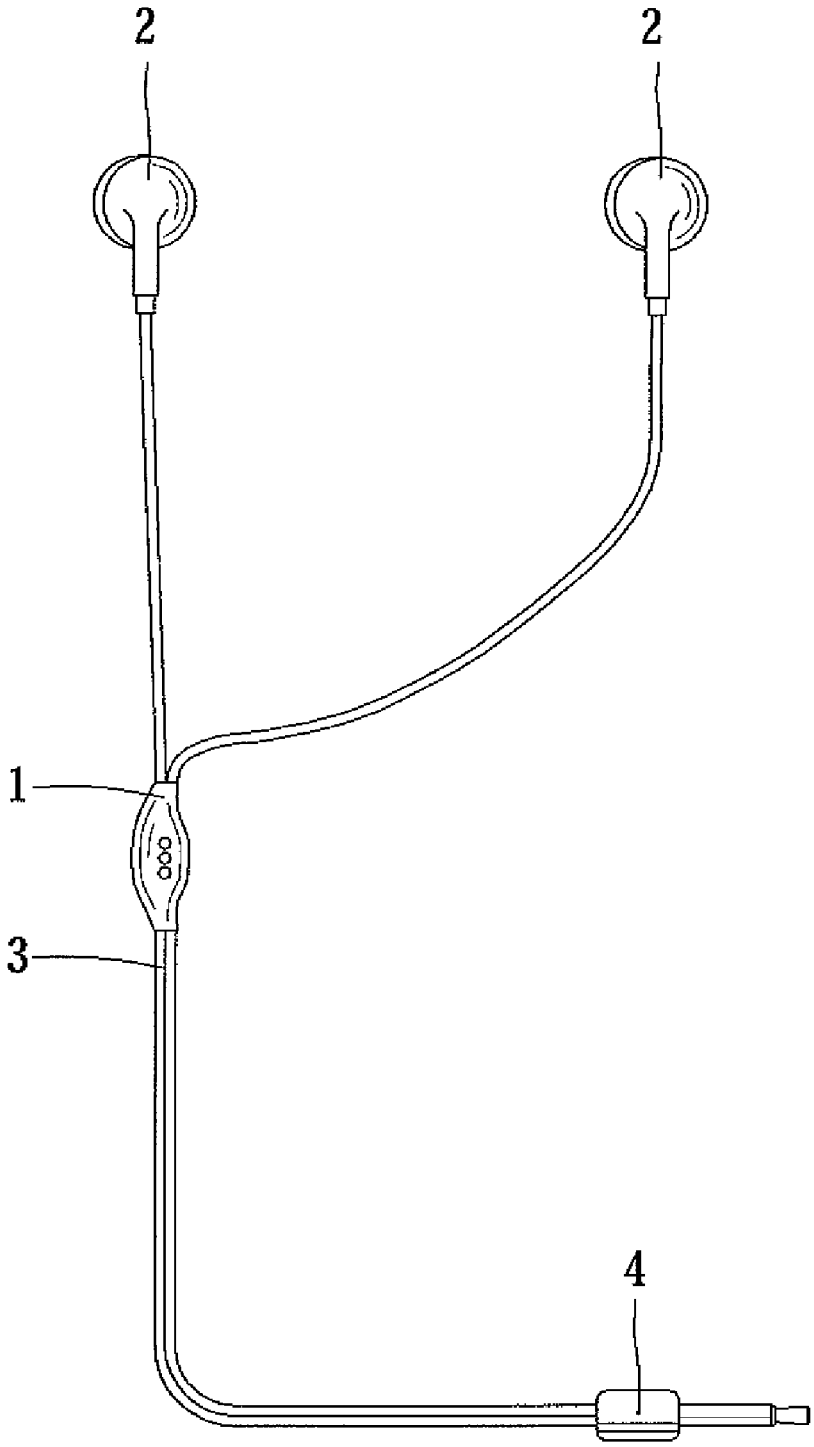
Fig.1 PRIOR ART
FIG. 1 is a perspective view of a conventional accessory associated with a mobile device.
Figure 2:
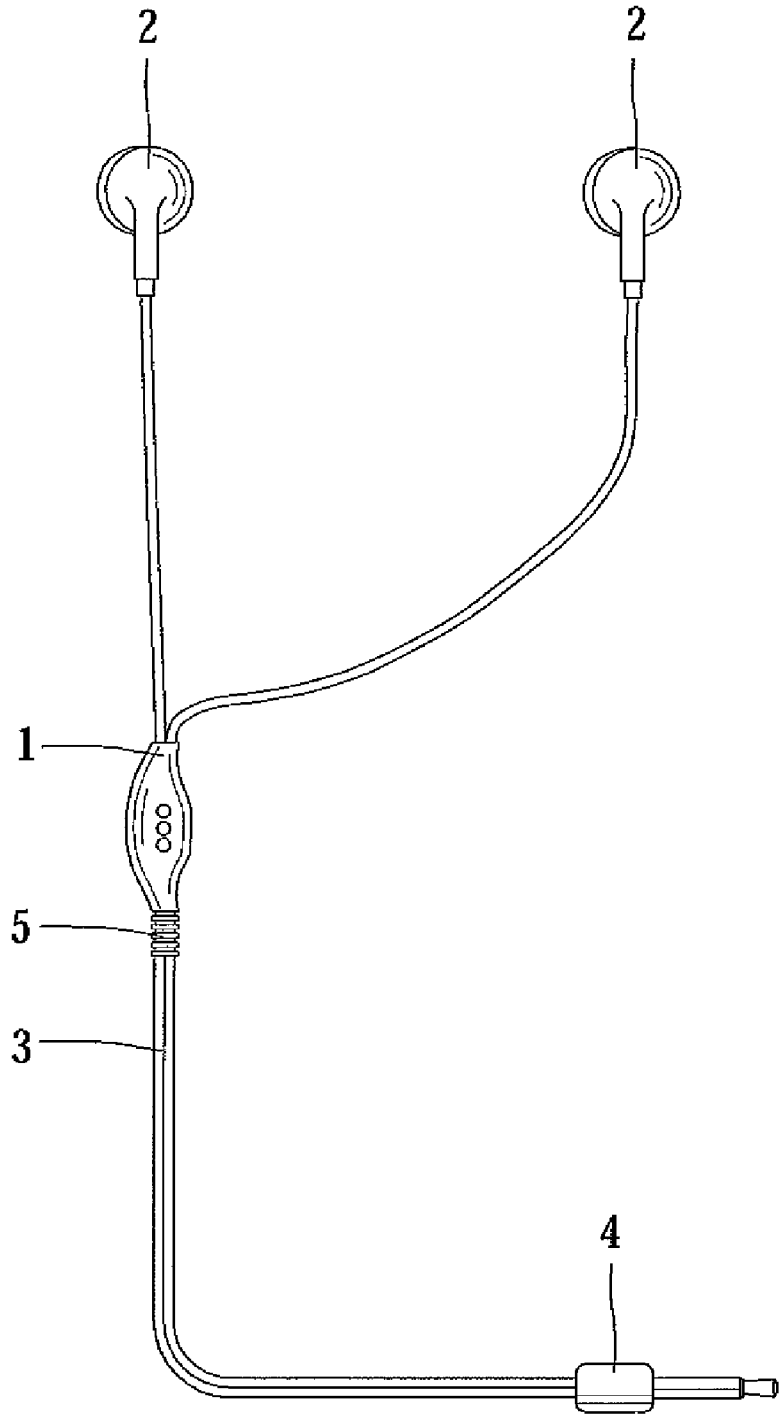
Fig.2 PRIOR ART
FIG. 2 is perspective view of another conventional accessory.
Figure 3:
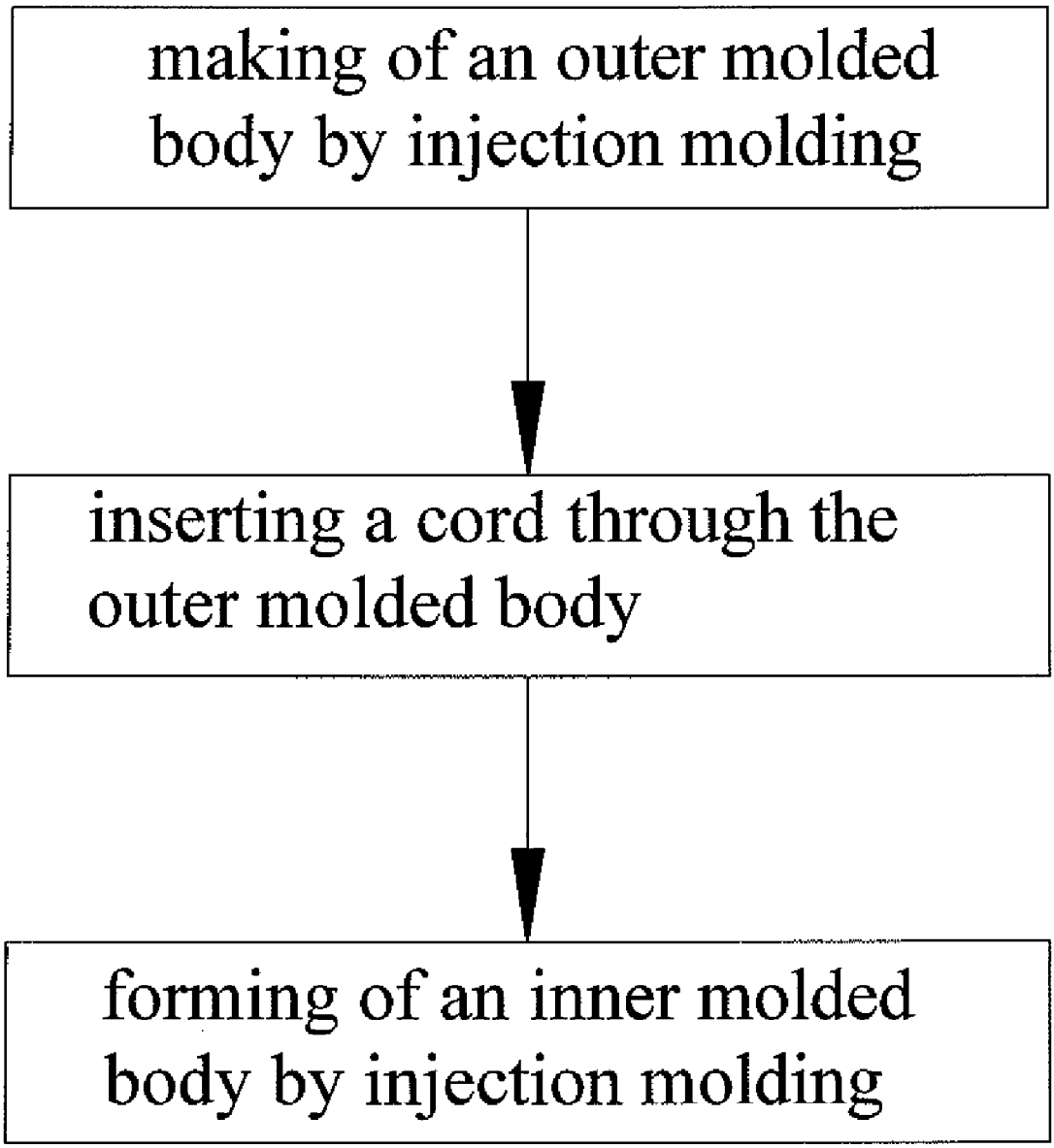
FIG. 3 is a flowchart showing steps for making a strain relief collar for use with an accessory associated with a mobile device in accordance with a first embodiment of the present invention.

FIG. 3 is a flowchart showing steps for making a strain relief collar for an accessory 90 in accordance with a first embodiment of the present invention. In this exemplary embodiment, the accessory 90 is a microphone for a mobile device.

The first step in the practice of this invention is the making of an outer molded body 10. The outer molded body 10 is injection molded from thermoplastic elastomer (TPE) and has a hardness of 70 A.

Figure 4:
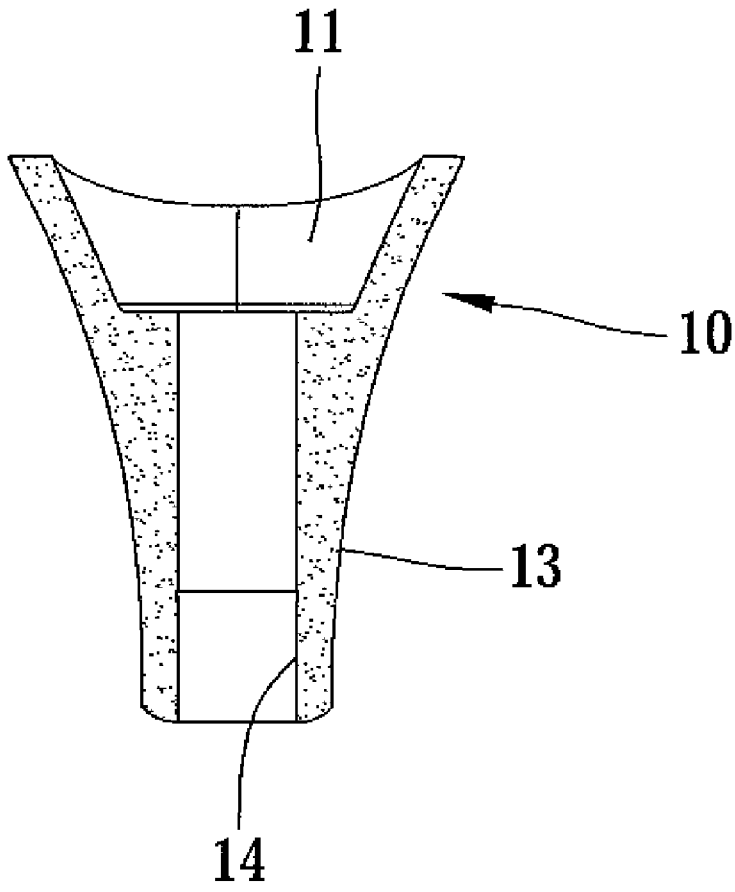
FIG. 4 is a cross-sectional view illustrating the strain relief collar according to the first step of the invention.
Figure 5:
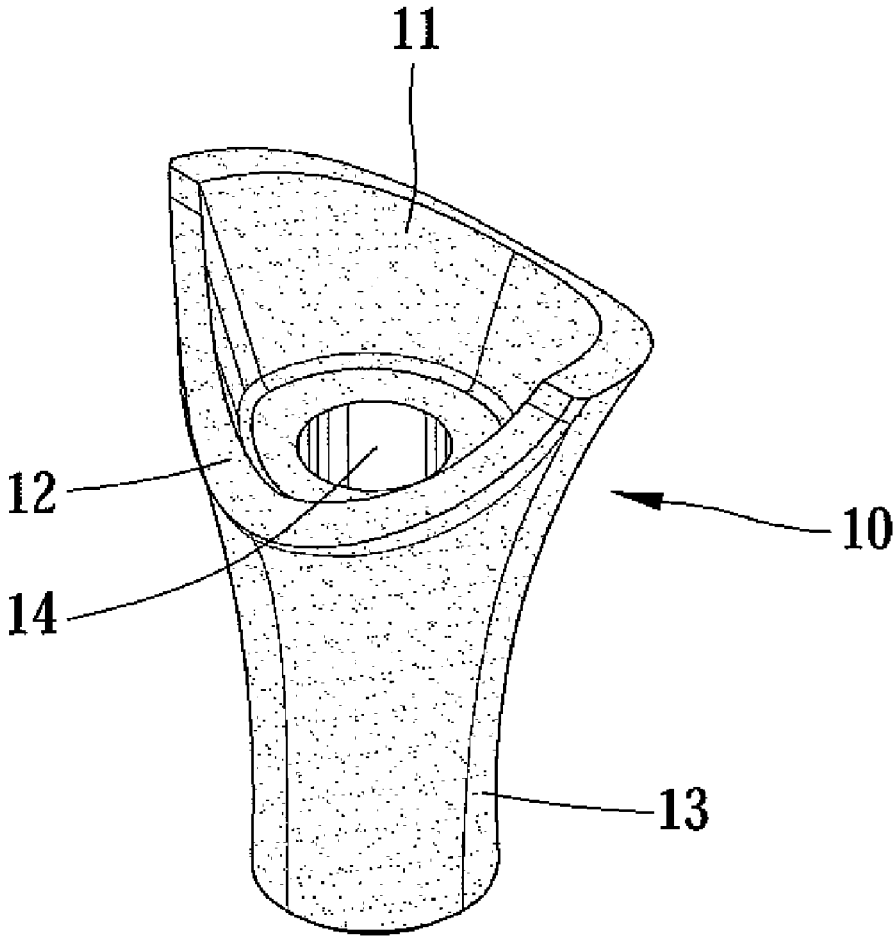
FIG. 5 is a perspective view of the inner molded body shown in FIG. 4.

Referring to FIGS. 4 and 5, the outer molded body 10 is of horn-shaped, with an end which progressively becomes wider at an opposite end and defines an extended portion 13 at a narrower end. The outer molded body 10 also includes a recessed engagement portion 11 formed at a wider end thereof and on the peripheral wall thereof, there is formed a cutout 12. Furthermore, the extended portion 13 has a smooth outer periphery for preventing the formation of dirt therein. In addition, the extended portion 13 includes a bore 14 in communication with the engagement portion 11.

Figure 6:
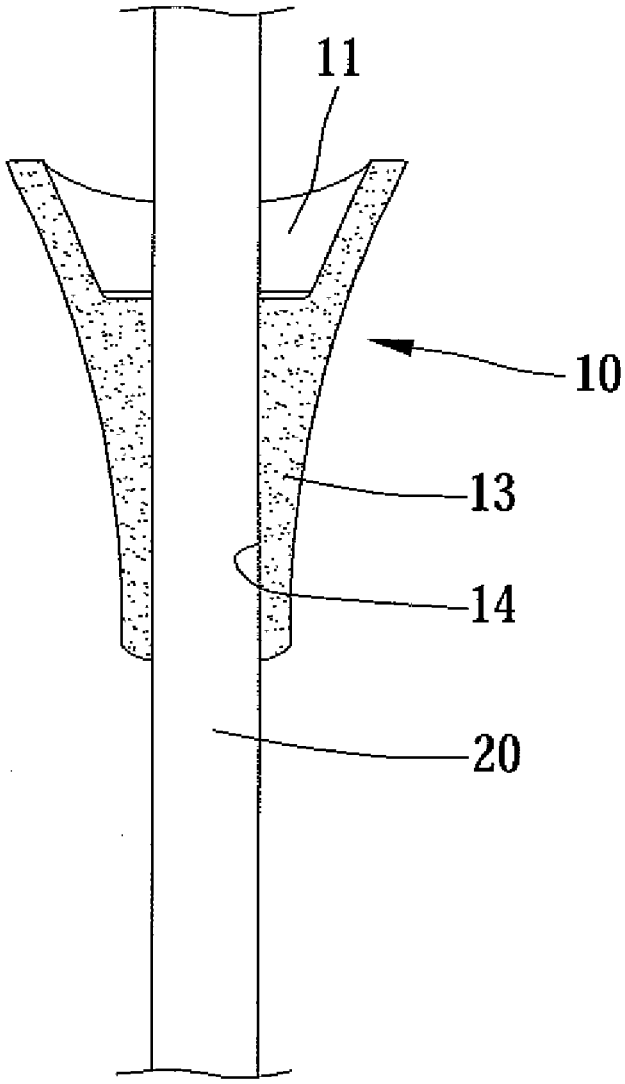
FIG. 6 is a cross-sectional view illustrating the strain relief collar according to the second step of the invention.

The second step in the practice of this invention is inserting a cord 20 into the bore 14 until the cord 20 exposes outside the engagement portion 11, as seen in FIG. 6.

The third step in the practice of this invention is the forming of an inner molded body 30, in which the inner molded body 30 is injection molded from thermoplastic elastomer (TPE) and has a hardness of 100 A which is harder than the outer molded body but softer than the accessory 90.

Figure 7:
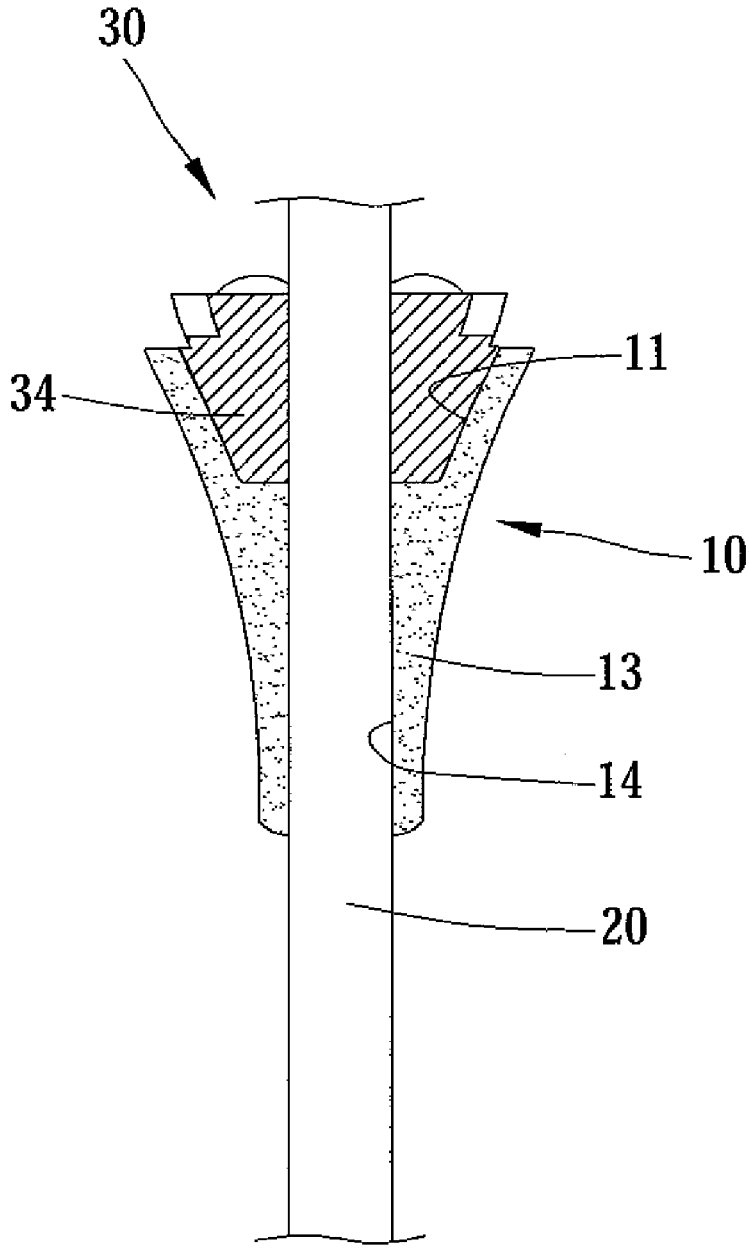
FIG. 7 is a cross-sectional view illustrating the strain relief collar according to the third step of the invention.
Figure 8:
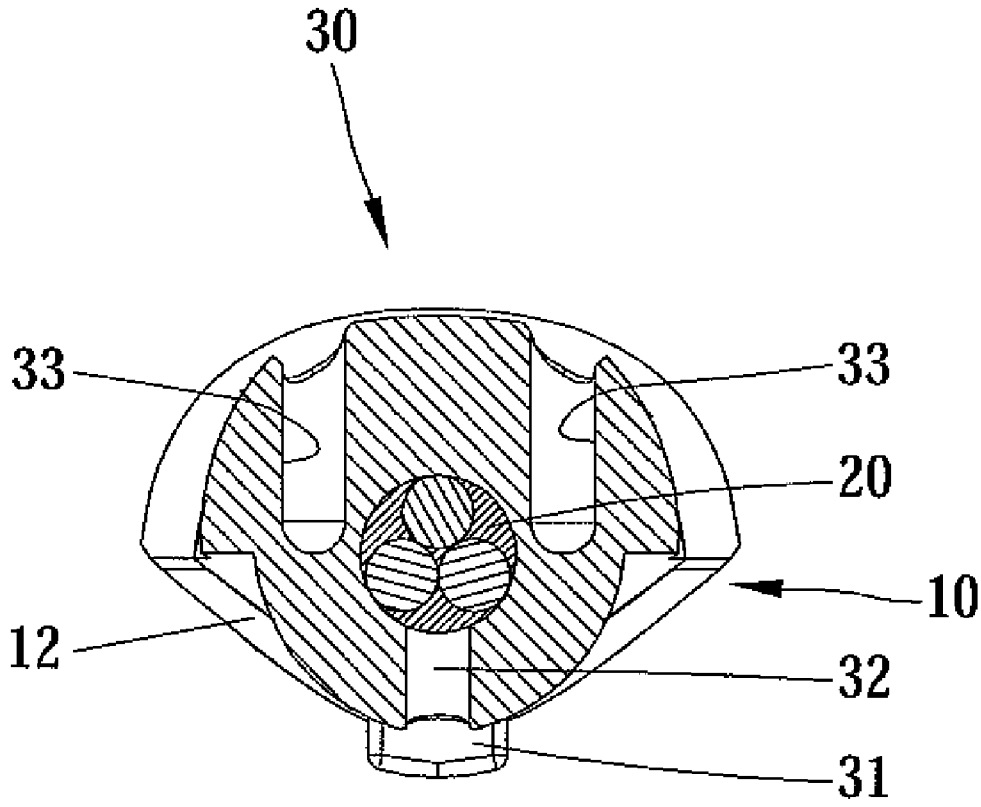
FIG. 8 is top, cross sectional view of the strain relief collar shown in FIG. 7.
Figure 9:
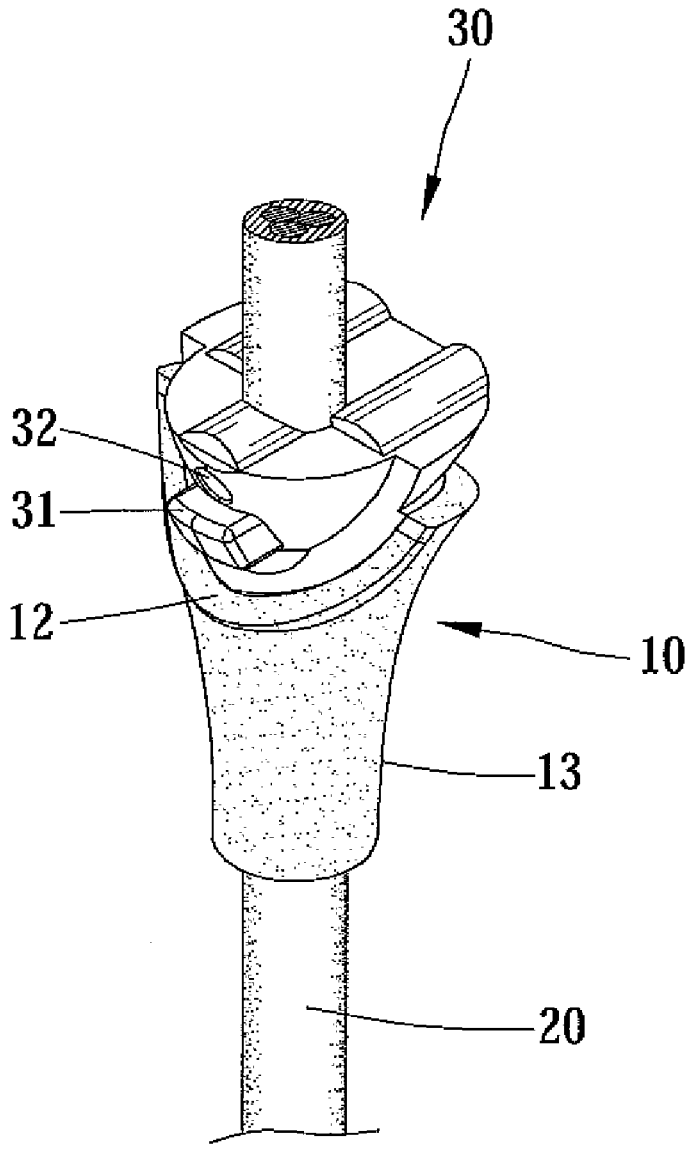
FIG. 9 is a perspective view of the strain relief collar shown in FIG. 7.

Referring to FIGS. 7 through 9, the inner molded body 30 is injection molded in the engagement portion 11 such that the cord 20 and the outer molded body 10 are connected by the inner molded body 30. Furthermore, the inner molded body 30 defines a supporting portion 34 attached with the engagement portion 11. The supporting portion 34 can prevent excessive bending of the cord 20 which can result a broken circuit. Additionally, the portion of the cord 20 exposed outside the outer molded body 10 is partially circumscribed by the inner molded body 30 and partially left exposed.

As also seen from FIGS. 7 through 9, a hooking portion 31, an engaging slot 32 and two locking slots 33 are formed by the inner molded body 30 for engagement with the accessory 90. The hooking portion 31 extends outward from the periphery thereof and beyond the cutout 12. The engaging slot 32 and the locking slots 33 extend inward from the inner molded body 30, but with the former extending in an opposite direction to the latter. Additionally, the engaging slot 32 is disposed adjacent to the hooking portion 31.

Figure 10:
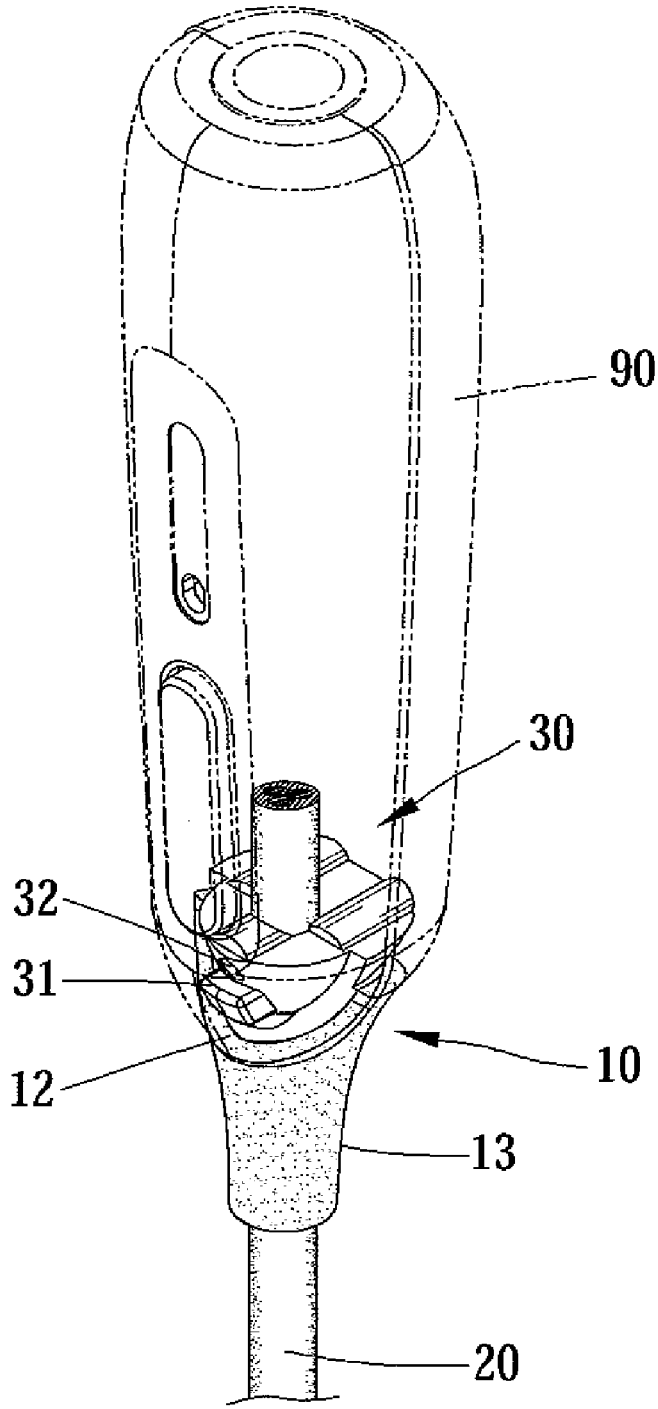
FIG. 10 is a perspective view showing the strain relief collar connected to an accessory, with the accessory shown in phantom.

The finished product of the strain relief collar is best shown in FIG. 9 and is readily engagable with the accessory 90, which is the microphone (as seen in FIG. 10). The accessory 90 is fixed to the inner molded body 30 by engaging with the hooking portion 31, the engaging slot 32 and the locking slots 33.

Figure 11:
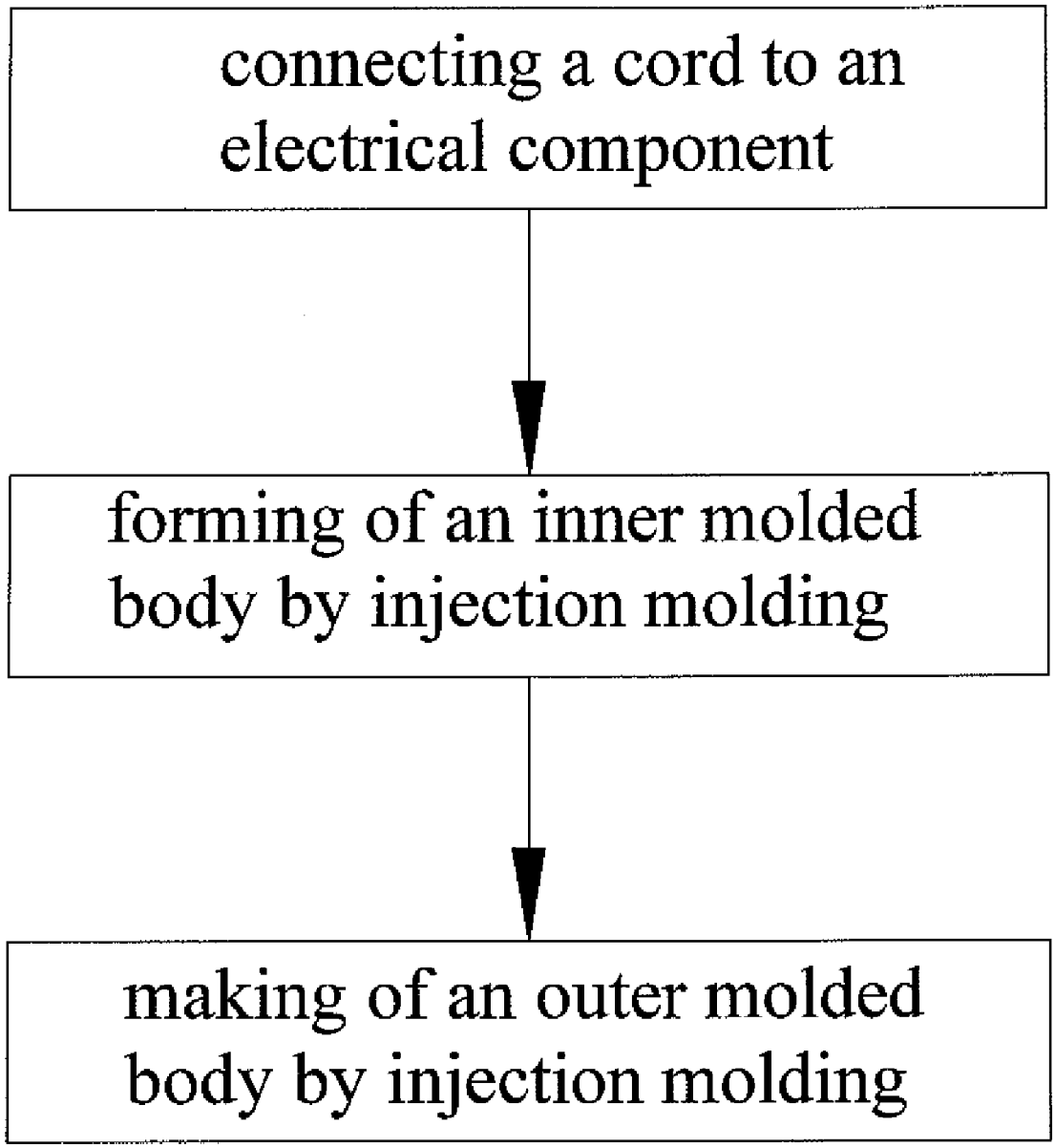
FIG. 11 is a flowchart showing steps for making a strain relief collar for use with an accessory associated with a mobile device in accordance with a second embodiment of the present invention.

FIG. 11 is a flowchart showing steps for making a strain relief collar for an accessory 91 associated with a mobile device in accordance with a second embodiment of the present invention. In this exemplary embodiment, the accessory 91 for a mobile device is a connector plug.

Figure 12:
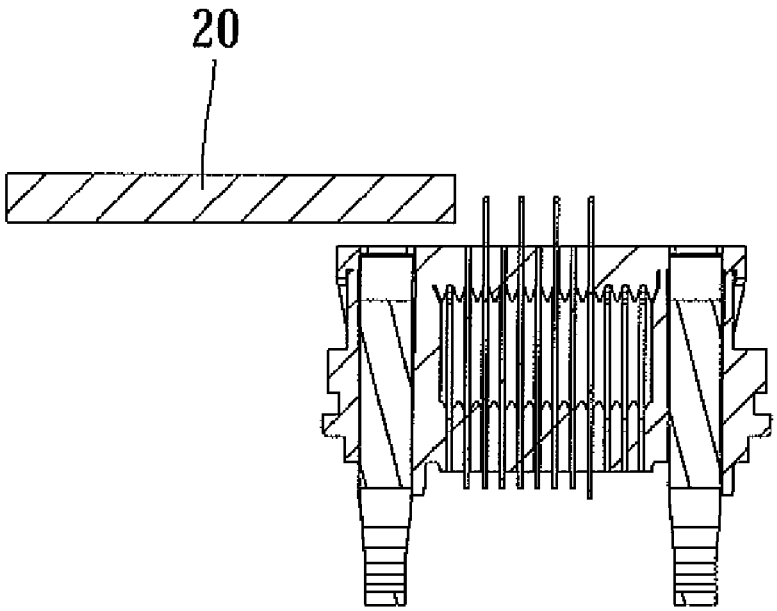
FIG. 12 is a cross-sectional view illustrating the strain relief collar according to the first step of the invention.

Referring to FIG. 12, at the first step in the practice of this invention, the cord 20 is connected to an electrical component (not numbered), i.e. a terminal platform.

At the second step in the practice of this invention, an inner molded body 40 is injection molded from thermoplastic elastomer (TPE) and which has a hardness of 100 A, which has less hardness than the electrical component.

Figure 13:
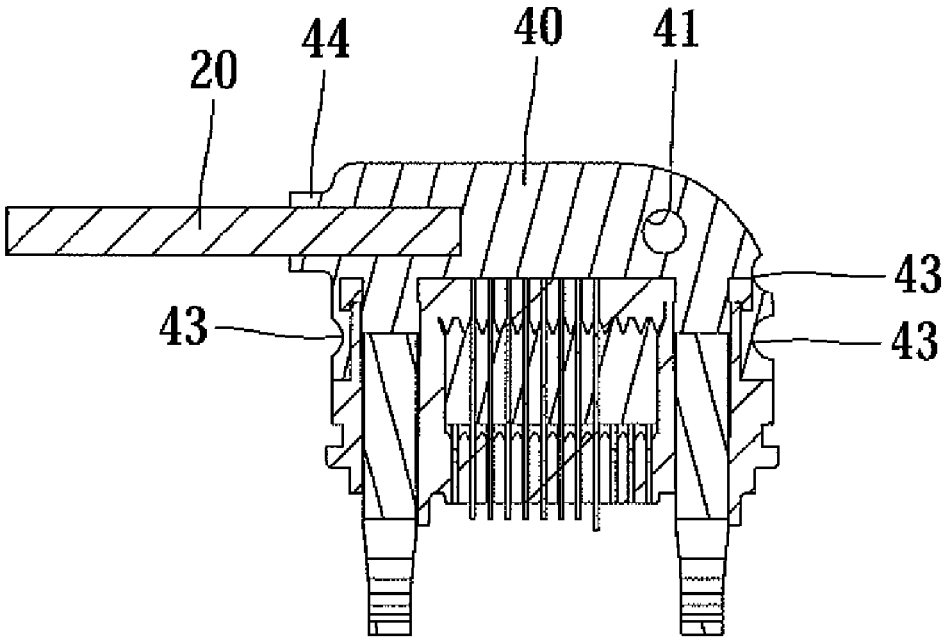
FIG. 13 is a cross-sectional view illustrating the strain relief collar according to the second step of the invention.
Figure 14:
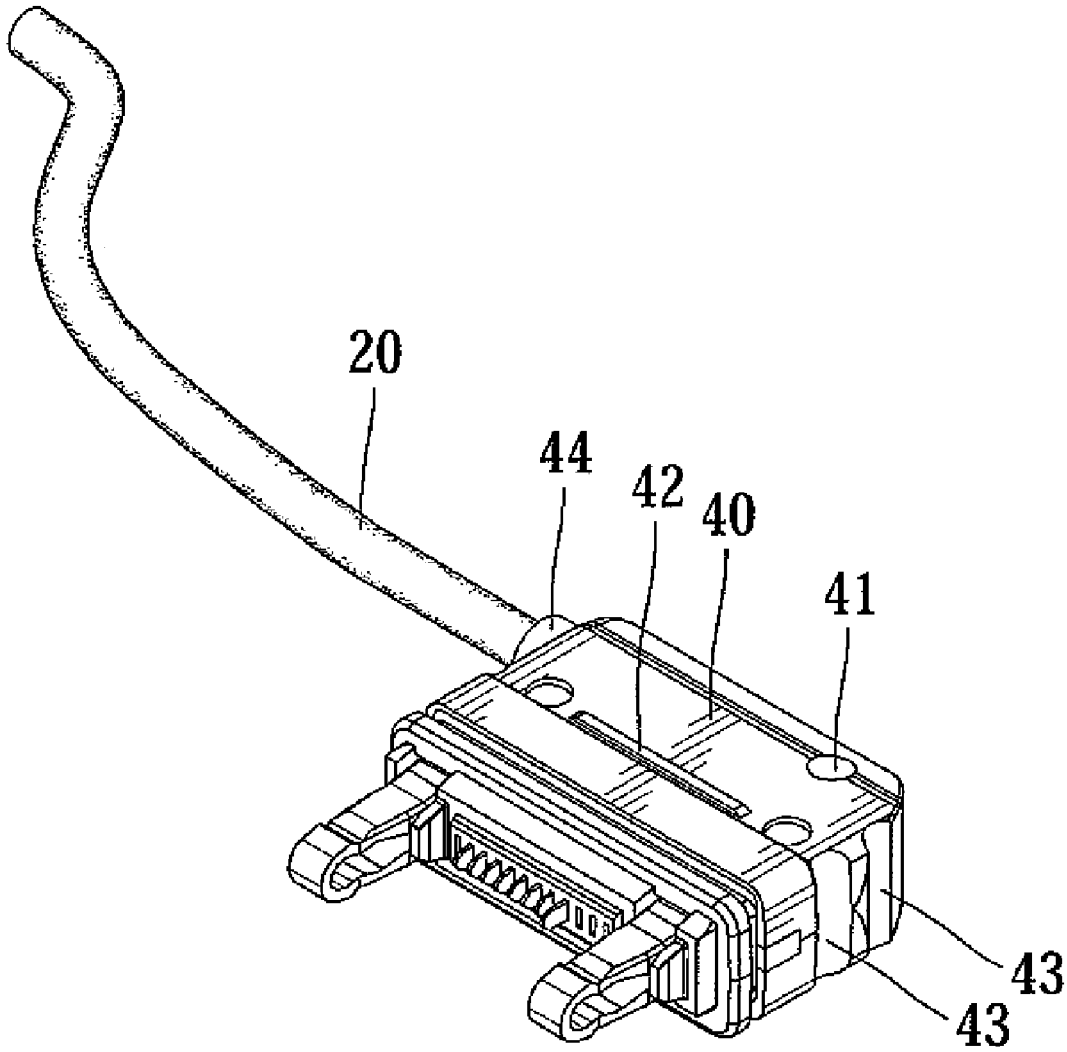
FIG. 14 is a perspective view of the strain relief collar shown in FIG. 13.

Referring to FIGS. 13 and 14, the cord 20 and the electrical component are partially surrounded by the inner molded body 40 such that the cord 20 and the electrical component are firmly engaged with each other by the inner molded body 40. The inner molded body 40 also includes an engaging slot 41 and a plurality of arcuate locking slots 43 extending transversely therethrough. Furthermore, the inner molded body 40 defines a supporting portion 44 circumscribing the outer periphery of the cord 20 for preventing excessive bending of the cord 20 which can result a broken circuit.

Figure 15:
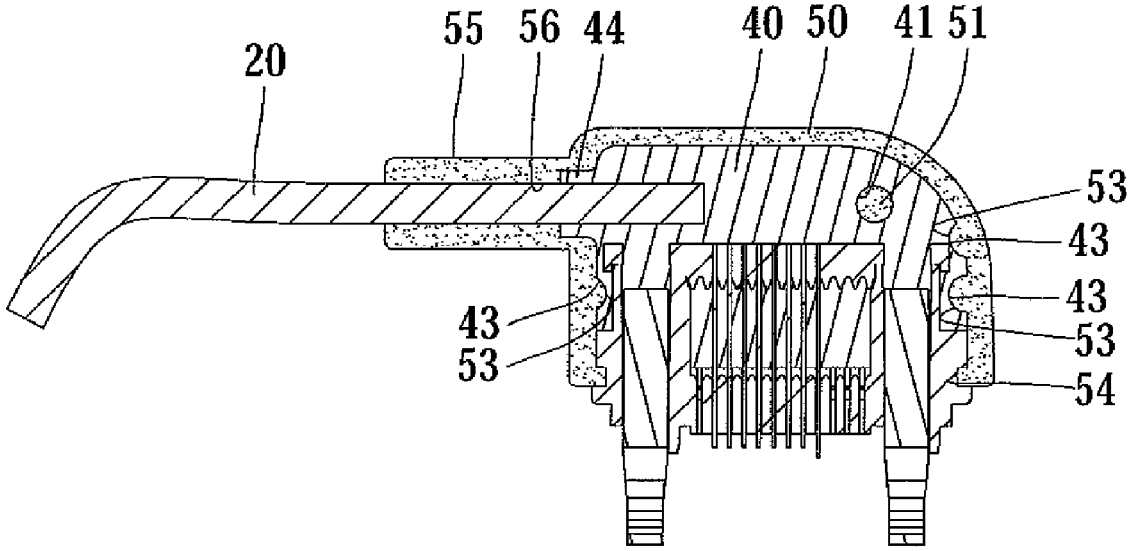
FIG. 15 is a cross-sectional view illustrating the strain relief collar according to the third step of the invention.
Figure 16:
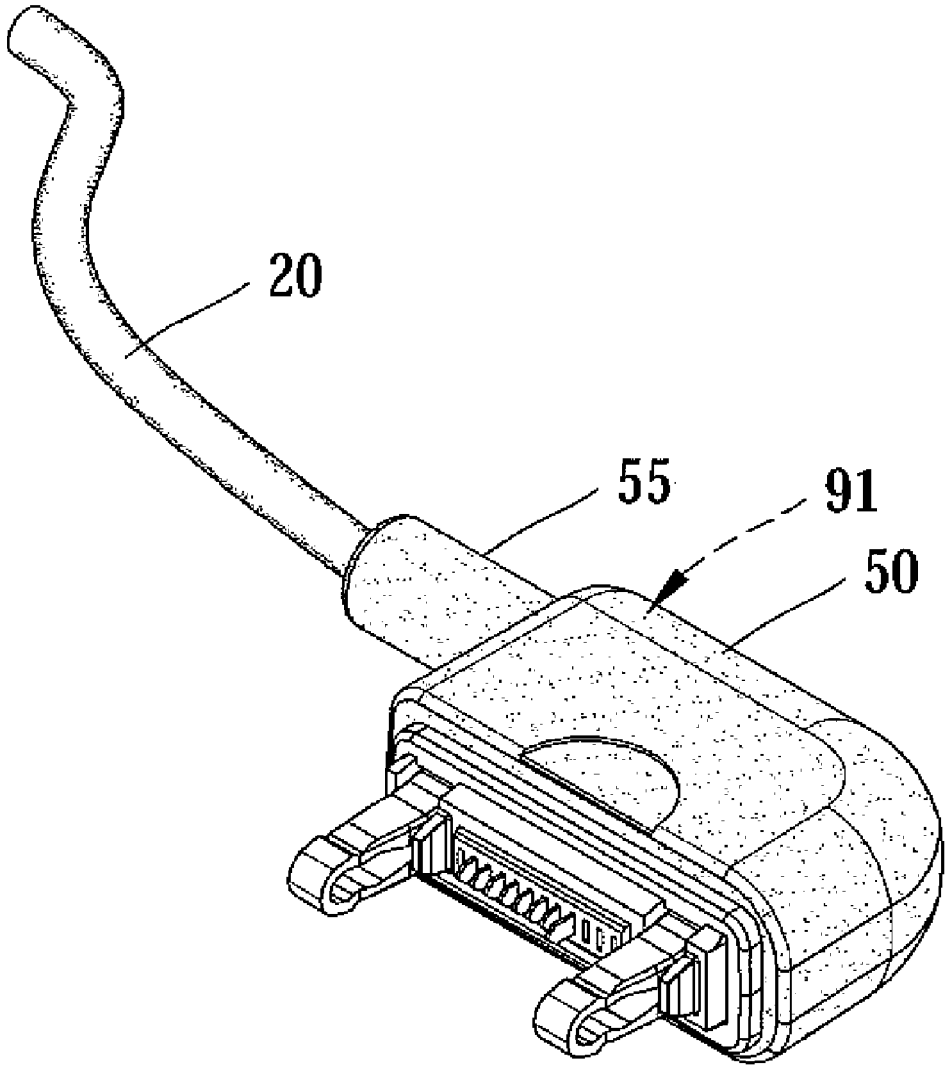
FIG. 16 is a perspective view of the strain relief collar shown in FIG. 14.

At the third step in the practice of this invention, an outer molded body 50 which has a hardness of 70 A is injection molded from thermoplastic elastomer (TPE). Referring to FIGS. 15 and 16, the inner molded body 40 is completely surrounded by the outer molded body 50. The cord 20 and the electrical component are partially enclosed by the outer molded body 50. The outer molded body 50 includes a terminating edge 54 engaged with the electrical component for secure attachment to the inner molded body 40, an engaging column 51 disposed in the engaging slot 41 and a plurality of locking members 53 disposed in the corresponding locking slots 43. Accordingly, the outer molded body 50 is firmly connected to the inner molded body 40.

As also seen in FIG. 15, the outer molded body 50 includes an extended portion 55 extending axially corresponding to the supporting portion 44. The extended portion 55 has a smooth outer periphery for preventing the formation of dirt therein and an orifice 56 which allows the portion of the cord 20 disposed therein to be supported and thereby prevent excessive bending of the cord 20.

Figure 17:
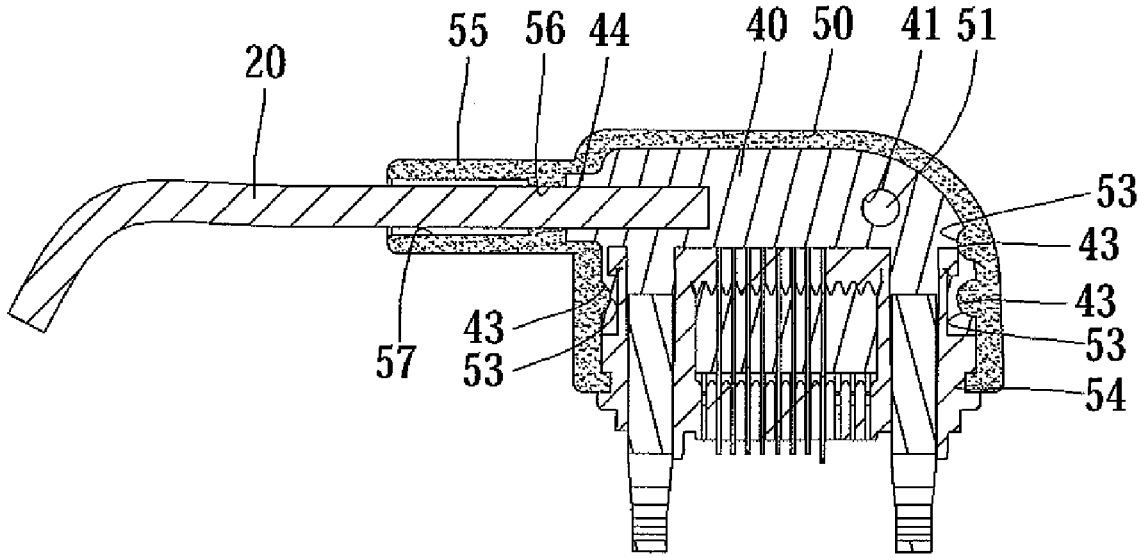
FIG. 17 is a cross-sectional view of the strain relief collar in accordance with the second embodiment of the invention.

Referring to FIG. 17, the extended portion 55 includes an indentation 57 formed around the inner periphery thereof. The indentation 57 extends from an end thereof until it reaches the orifice 56.

Thus, in view of the embodiments illustrated herein, one advantage is the provision of the inner molded body 30, 40 and the outer molded body 10, 50 which are formed of the same material. As such, the inner molded body 30, 40 and the outer molded body 10, 50 can be tightly engaged with each other.

Another advantage is that the provision of the inner molded body 30, 40 for inhibiting the cord 20 from being easily pulled off the accessory 90, 91.

Yet another advantage of the invention is the provision of the extended portion 13, 55 for preventing dirt from being easily accumulated thereto.

While the specific embodiments have been illustrated and described, numerous modifications come to mind without significantly departing from the spirit of invention and the scope of invention is only limited by the scope of accompanying claims.

What is claimed is:

1. A method for making a strain relief collar for an accessory associated with mobile device comprising the steps of:

injection molding an outer molded body which has an engagement portion, an extended portion opposite to said engagement portion, and the extended portion having a bore in communication with the engagement portion;

inserting a cord through the outer molded body and providing a portion thereof extended outside the outer molded body; and injection molding an inner molded body in the engagement portion such that the inner molded body engages the cord and the outer molded body; wherein the cord is partially circumscribed by the inner molded body and partially left exposed for electrically connecting to an accessory associated with mobile device; wherein said engagement portion comprises a cutout, and the inner molded body has a hooking portion extending outward from the periphery thereof and beyond the cutout for engaging with an accessory.

2. The method as claimed in claim 1, wherein said outer molded body and inner molded body are made of thermoplastic elastomer (TPE), and the inner molded body has a hardness greater than the outer molded body.

3. The method as claimed in claim 1, wherein said inner molded body comprises an engaging slot and two locking slots extending inward from the periphery thereof for engaging with the accessory.

4. A method for making a strain relief collar for an accessory associated with mobile device comprising the steps of:

connecting a cord to an electrical component of an accessory associated with mobile device;

injection molding an inner molded body which surrounds the electrical component, and the inner molded body having a supporting portion circumscribing the cord; and injection molding an outer molded body which encloses the inner molded body and partially encloses said cord and electrical component;

wherein the outer molded body has an extended portion having a smooth outer periphery extending axially corresponding to the supporting portion, and having an indentation between the inner periphery thereof and the cord.

5. The method as claimed in claim 4, wherein the outer molded body and inner molded body are made of thermoplastic elastomer (TPE), and the inner molded body has a hardness greater than said outer molded body.

6. The method as claimed in claim 4, wherein the inner molded body comprises an engaging slot extending transversely, and the outer molded body comprises an engaging column disposed in said engaging slot, allowing a firm attachment between the inner molded body and the outer molded body.

7. The method as claimed in claim 4, wherein the inner molded body comprises a plurality of arcuate locking slots formed about the periphery thereof, and the outer molded body defines a plurality of locking members disposed corresponding to said plurality of locking slots respectively, allowing a firm attachment between said inner molded body and outer molded body.

8. A strain relief collar for an accessory associated with mobile device comprising:

a cord;

an inner molded body circumscribing the cord and defining a supporting portion; and an outer molded body enclosing the inner molded body and defining an extended portion extending axially corresponding to said supporting portion; and wherein the extended portion includes a smooth outer periphery, said outer molded body and inner molded body are made of the same material, and said inner molded body has a hardness greater than said outer molded body; and wherein the outer molded body comprises an engagement portion with a cutout and the inner molded body comprises a hooking portion extending outward from the periphery thereof and beyond the cutout for engaging with an accessory.

9. The strain relief collar as claim 8, wherein said inner molded body comprises an engaging slot and two locking slots extending inward from the periphery thereof for engaging with the accessory.

* * * * *